US005271613A

United States Patent [19]

Hain

[11] Patent Number: 5,271,613

[45] Date of Patent: Dec. 21, 1993

[54] APPARATUS FOR LOADING AND PICKING SHEETS

[75] Inventor: David A. Hain, Monifieth, Scotland

[73] Assignee: NCR Corporation, Dayton, Ohio

[21] Appl. No.: 995,245

[22] Filed: Dec. 22, 1992

[30] Foreign Application Priority Data

Aug. 7, 1992 [GB] United Kingdom ..... 9216806

[51] Int. Cl.[5] ..... B65H 5/22

[52] U.S. Cl. ..... 271/3.1; 271/163; 271/214

[58] Field of Search ..... 271/3.1, 149, 157, 163, 271/213, 214, 215

[56] References Cited

U.S. PATENT DOCUMENTS 4,501,416 2/1985 Hain .
4,513,958 4/1985 Kokubo et al. ..... 271/163 X

FOREIGN PATENT DOCUMENTS 0317537 5/1989 European Pat. Off. .
218440 9/1988 Japan ..... 271/163
242360 9/1989 Japan ..... 271/163
2104877 3/1983 United Kingdom .
2135494 8/1984 United Kingdom .
2135977 9/1984 United Kingdom .

*Primary Examiner*—H. Grant Skaggs
*Assistant Examiner*—Boris Milef
*Attorney, Agent, or Firm*—Albert L. Sessler, Jr.

[57] ABSTRACT

An apparatus for loading currency notes into and picking notes from a currency cassette (14) includes a movable support member (56) on which the cassette (14) is mounted and which is movable together with the cassette (14) between an operative position in which loading or picking takes place and a non-operative position. Lower and upper stack retaining pawls (180, 182) are pivotably movable between operative positions in which they engage lower and upper front edges of a stack of notes (44) held in the cassette (14) and non-operative positions. When the apparatus changes from a picking to a loading mode, the support member (56) is moved to its non-operative position and the pawls (180, 182) are moved to their operative positions, after which the support member (56) is moved back to its operative position, the stack (44) being urged against the pawls (180, 182) so as to form a space (208) in front of the stack (44) for accommodating notes to be loaded into the cassette (14).

10 Claims, 8 Drawing Sheets

APPARATUS FOR LOADING AND PICKING SHEETS

BACKGROUND OF THE INVENTION

This invention relates to a sheet handling apparatus for loading sheets into, and picking sheets one by one from, the same receptacle. The invention has application, for example, to an apparatus for loading currency notes into, and picking notes from, a currency cassette.

Currency cassettes are used, for example, in automated teller machines (ATMs) of the kind wherein a user inserts a user identifying card into the machine and then enters certain data (such as codes, quantity of currency required or to be paid in, type of transaction, etc.) upon one or more keyboards associated with the machine. The machine will then process the transaction, update the user's account to reflect the current transaction, dispense cash, when requested, extracted from one or more currency cassettes mounted in the machine, and return the card to the user as part of a routine operation. It is common for an ATM to dispense currency notes of at least two different denominations, in which case the ATM will normally include a separate currency cassette for notes of each particular denomination.

SUMMARY OF THE INVENTION

The invention has particular application to a cash recycling ATM in operation of which currency notes deposited in the ATM by one customer may be dispensed by the ATM to another customer.

According to the present invention there is provided a sheet handling apparatus operable in a loading mode and in a picking mode, comprising a receptacle arranged to hold a stack of sheets and including a pusher member to urge said sheets, when said apparatus is in a picking mode, against a stop member in said receptacle; loading means for loading sheets into said receptacle when said apparatus is in said loading mode; picking means for picking sheets one by one from said receptacle when said apparatus is in said picking mode; a movable support member on which said receptacle is mounted in operation; first actuating means arranged to move said support member together with said receptacle between an operative position in which loading or picking takes place and a non-operative position; movable stack retaining means operable to retain the stack of sheets within the receptacle; second actuating means arranged to move said retaining means between operative and non-operative positions; and control means arranged to control the operation of said first and second actuating means, whereby when said support member is in said operative position, said stack retaining means are in their non-operative position during a picking mode and are in their operative position during a loading mode, and whereby, when said apparatus changes from a picking mode to a loading mode, said support member is moved to its non-operative position and said retaining means are moved to their operative position after which said support member is moved to its operative position, said pusher member urging said stack against said retaining means with a space having been created between said stack and said stop member for accommodating a plurality of sheets additional to said stack.

It is an object of the invention to provide a sheet handling apparatus for loading sheets into, and picking sheets one by one from, the same receptacle, which apparatus has a compact and simple form of construction.

Additional benefits and advantages of the present invention will become apparent to those skilled in the art to which this invention relates from the subsequent description of the preferred embodiments and the appended claims, taken in conjunction with the accompanying drawings.

DETAILED DESCRIPTION

Figure 1:
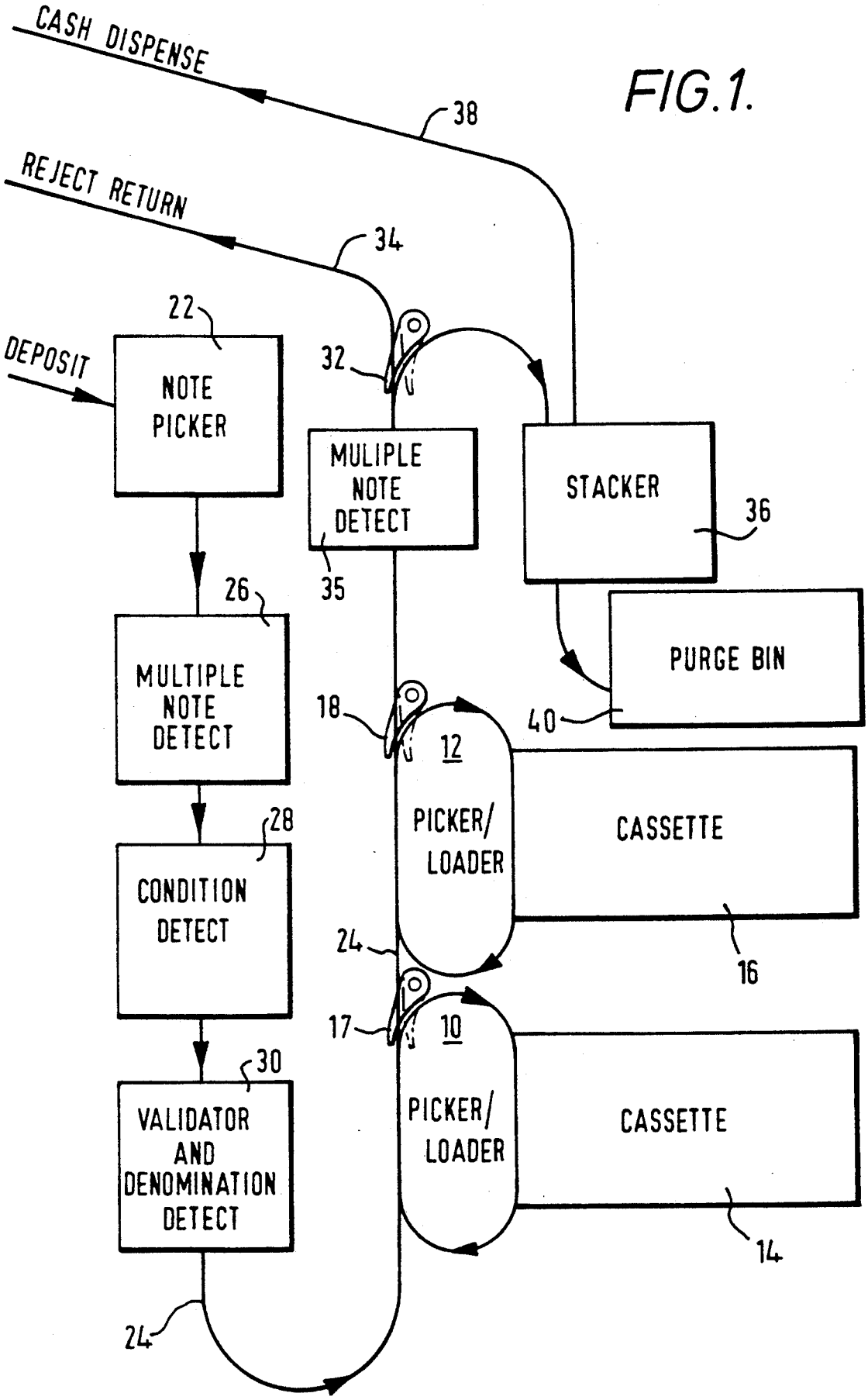
FIG. 1 is a schematic block diagram of a cash recycling ATM having two currency note picker/loader mechanisms in accordance with the invention.

Referring to FIG. 1 of the drawings, the cash recycling ATM shown therein includes two picker/loader mechanisms 10 and 12 in accordance with the invention respectively associated with two currency cassettes 14 and 16. The cassette 14 is arranged to have currency notes of a first denomination loaded into it and picked therefrom, and the cassette 16 is arranged to have currency notes of a second denomination, different from the first denomination, loaded into it and picked therefrom. The picker/loader mechanisms 10 and 12 have two gates 17 and 18 respectively associated therewith. Each of the gates 17 and 18 is selectively movable between a loading position shown in solid outline in FIG. 1 and a picking position shown in chain outline in FIG. 1 under the control of electronic control means 19 (FIG. 12) included in the ATM.

Figure 12:
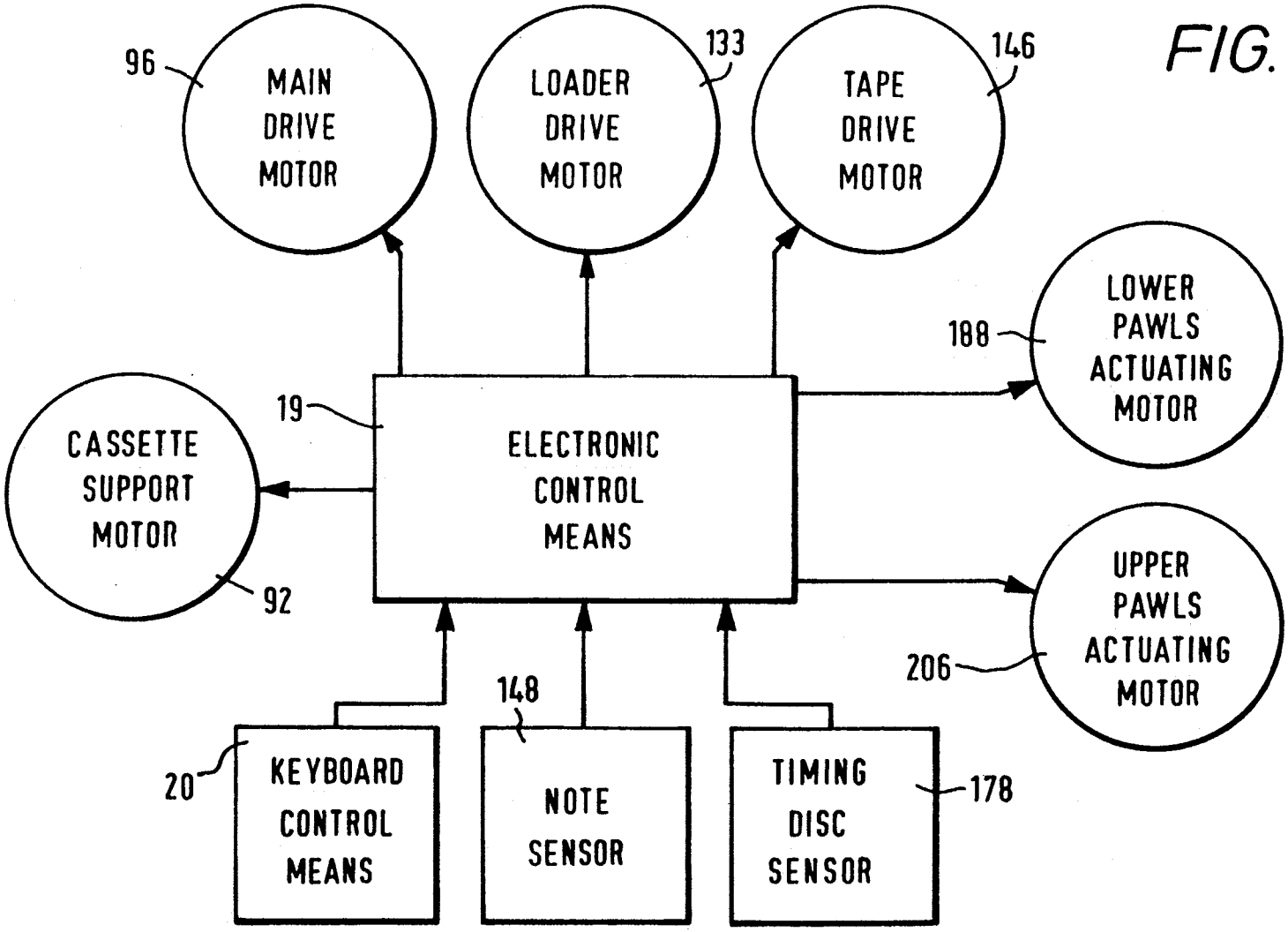
FIG. 12 is a block circuit diagram showing electrical interconnections of parts of the cash recycling ATM of FIG. 1.

Using keyboard control means 20 (FIG. 12), a user of the ATM can request the ATM to accept a cash deposit or to dispense cash. In conventional manner, the user inserts a user identifying card into the ATM, and enters on the keyboard control means 20 his personal identification number and the quantity of cash to be paid in or to be withdrawn. If a cash deposit mode of operation is requested, then the user deposits one or more currency notes of one or both of said first and second denominations into a note deposit slot (not shown) from where they are fed to note picker means 22. From the note picker means 22, deposited notes are fed along an entry feed path 24 via a multiple note detect means 26 for detecting the passage of multiple superposed sheets, via condition detect means 28 for determining whether each of the deposited notes is of acceptable condition, and via validator and denomination detect means 30 for determining whether each of the deposited notes is genuine and for determining the denomination of each genuine deposited note. If a deposited note is rejected by any of the above-mentioned means 26, 28 and 30, then the gates 17 and 18 are set to the picking position shown in chain outline in FIG. 1. Also, a further gate 32 is set to a reject position shown in chain outline in FIG. 1, the gate 32 being settable between the reject position and a stacking position shown in solid outline under the control of the electronic control means 19 (FIG. 12). The rejected note is then fed along a rejected note feed path 34 and returned to the customer at a rejected note exit slot (not shown). If a deposited note is accepted after having passed through the multiple note detect means 26, the condition detect means 28 and the validator and denomination detect means 30, then in a manner which will be described later the accepted note is loaded into the appropriate one of the cassettes 14 and 16 by the associated picker/loader mechanism 10 or 12, the associated gate 17 or 18 having previously been set to its loading position.

If a cash withdrawal mode of operation is requested, then the gates 17 and 18 are set to the picking positions shown in chain outline and the gate 32 is set to the note stacking position shown in solid outline. In accordance with the cash withdrawal request, an appropriate number of currency notes are picked in conventional manner from one or both of the cassettes 14 and 16 by the associated picker/loader mechanism(s) 10 and/or 12. The picked notes are fed via multiple note detect means 35 to conventional stacker means 36 where the notes are formed into a stack. Finally, the stack of notes is fed along an output feed path 38 to an exit slot (not shown) for collection by the user. If the multiple note detect means 35 detect the passage of multiple superposed notes, then, instead of being fed to the user, the stack of notes is fed from the stacker means 36 into a purge bin 40.

Figure 2:
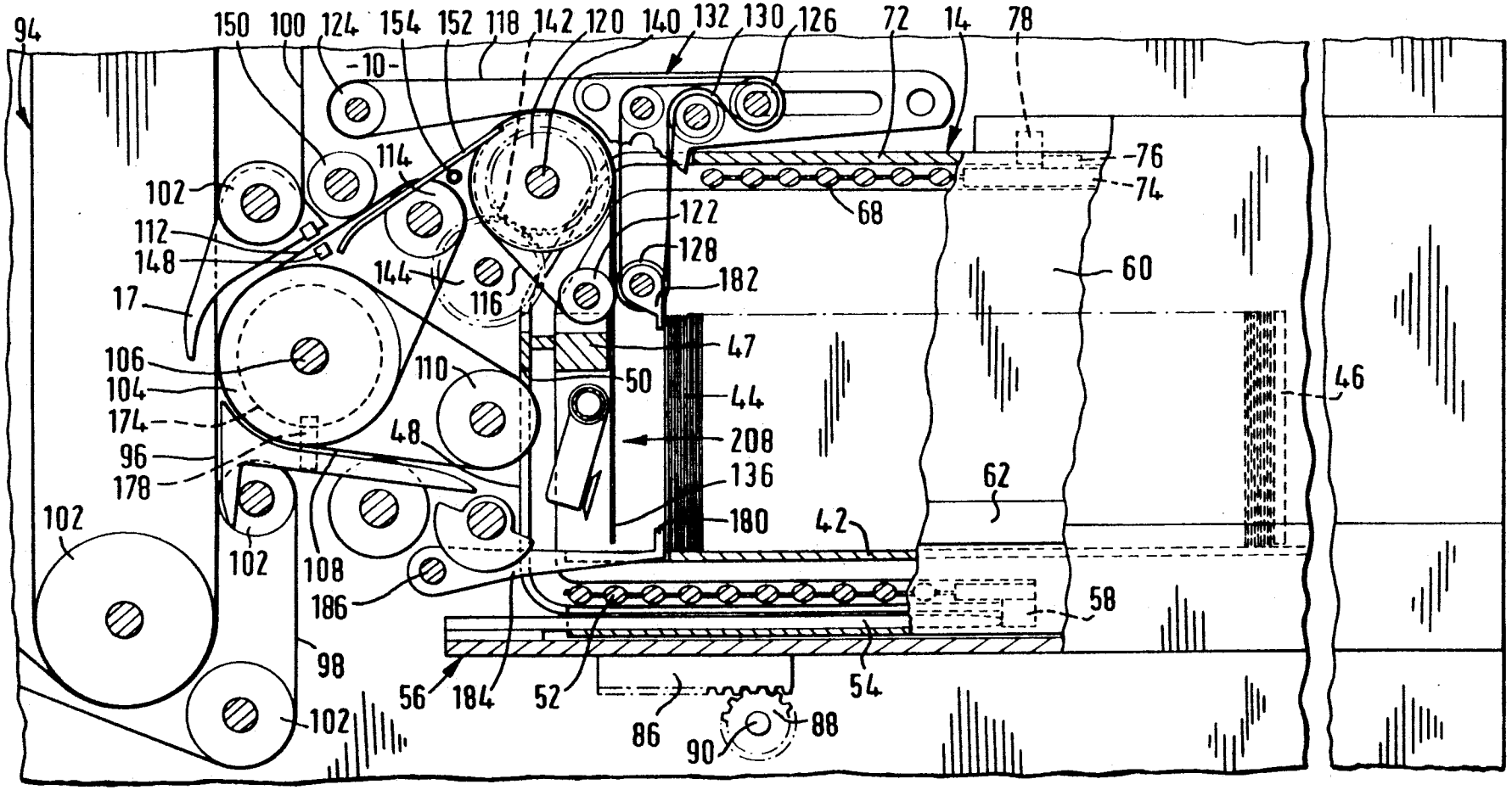
FIG. 2 is a part sectional, side elevation view, partly broken away, of a currency note picker/loader mechanism in accordance with the invention having a currency cassette mounted in association therewith, said mechanism being in a loading mode of operation.
Figure 4:
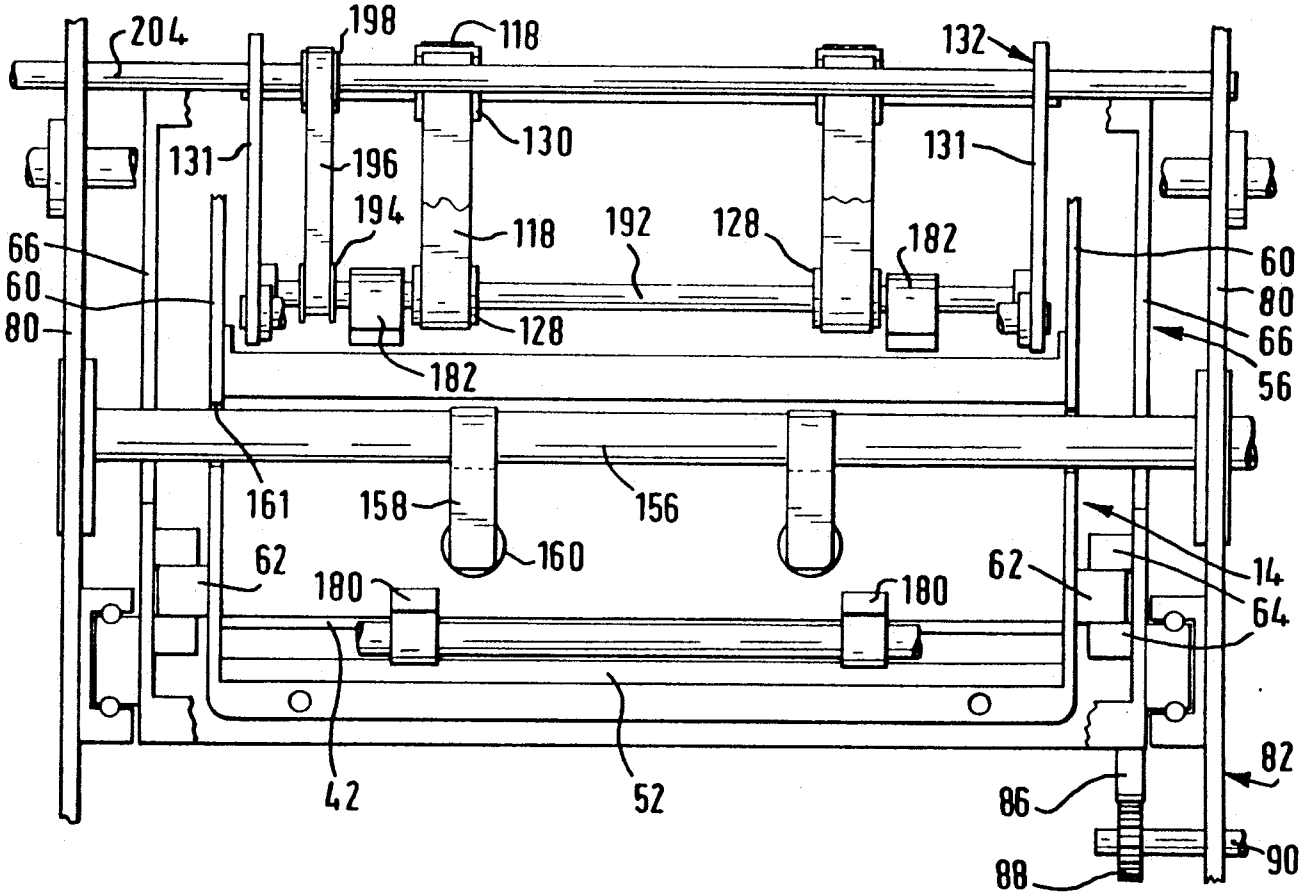
FIG. 4 is a front elevational view similar to FIG. 3 but with parts of the picker/loader mechanism shown in FIG. 3 being omitted for the sake of clarity.

The picker/loader mechanism 10 and the associated cassette 14 will now be described, it being understood that the picker/loader mechanism 12 and the cassette 16 are essentially the same as the mechanism 10 and the cassette 14. Referring initially to FIGS. 2 and 4, apart from a modification which will be described later, the cassette 14 is of a type which is well known in the art, the cassette 14 including a floor member 42 for supporting corresponding long edges of a stack of currency notes 44 housed in the cassette 14, and a pusher plate 46 (FIG. 2) which is slidably mounted on the floor member 42 and which is arranged to urge the stack of notes 44 under the action of spring means (not shown) towards a stop member 47 positioned adjacent the front end 48 of the cassette 14. In the lower half of the front end 48 there is provided an opening 50 through which notes are withdrawn one by one in conventional manner by the picker/loader mechanism 12 during a cash withdrawal operation involving the dispensing of notes from the cassette 14. When the cassette 14 is not mounted in the ATM, the opening 50 is closed by a flexible shutter 52. In a manner that is well known in the art, when the cassette 14 is mounted in the ATM, the shutter 52 is removed from the opening 50 to a position beneath the floor member 42 under the action of key pins 54 provided on a support member 56 for the cassette 14, the pins 54 engaging with projections 58 (FIG. 2) provided on the shutter 52. It should be understood that when the cassette 14 is removed from the ATM the shutter 52 is automatically returned to its closed position by spring means (not shown).

Figure 3:
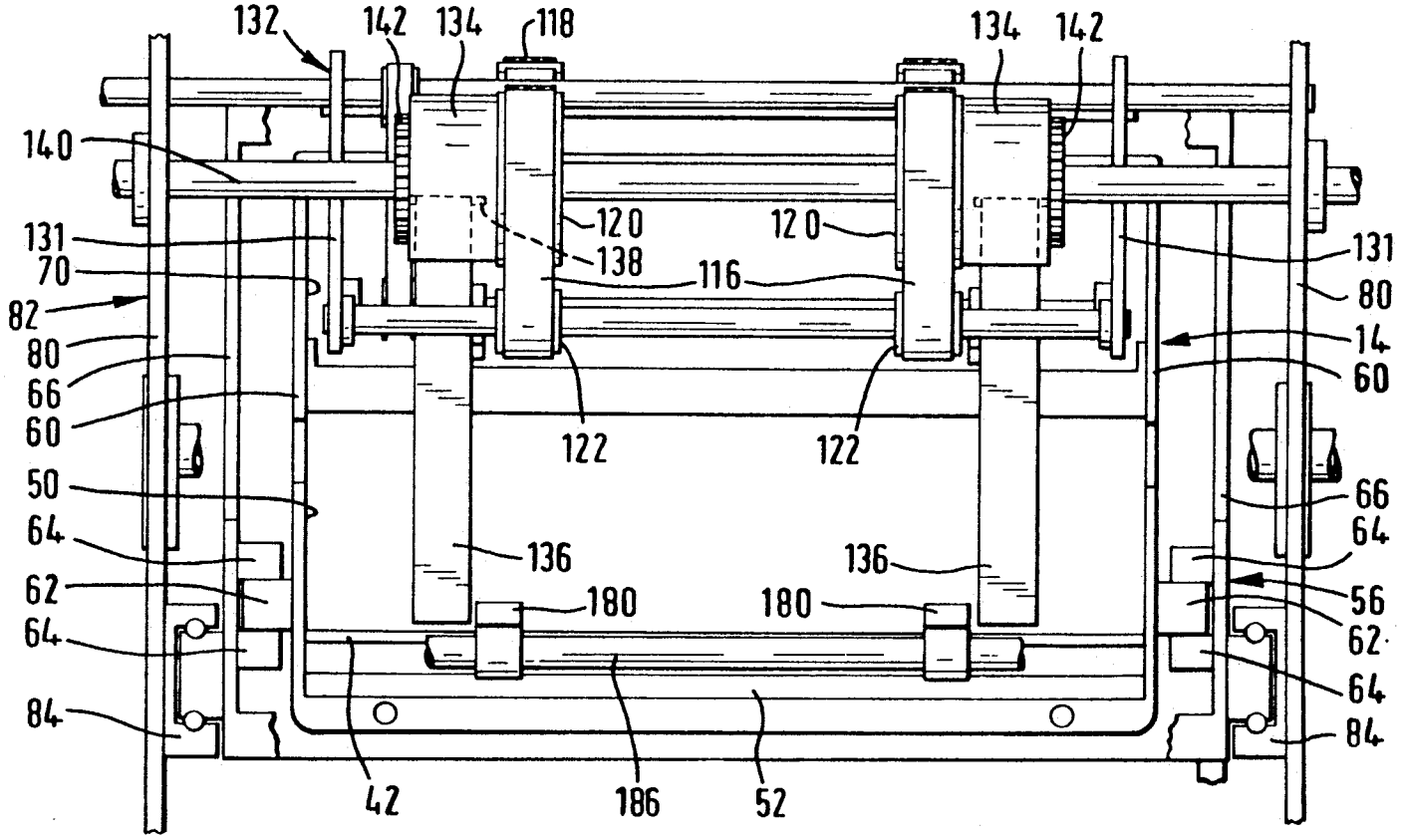
FIG. 3 is a front elevational view, partly broken away, of the cassette and part of the picker/loader mechanism of FIG. 2, the view being from left to right with reference to FIG. 2.

The cassette 14 is arranged to be removably mounted on the support member 56. The side walls 60 of the cassette 14 are respectively provided with horizontally extending ridge members 62 and, as seen in FIGS. 3 and 4, the cassette 14 is supported by the support member 56 by virtue of each of the ridge members 62 slidably engaging between a pair of horizontally extending guide bars 64 provided on an adjacent side wall 66 of the support member 56. When the cassette 14 is mounted in the ATM it is slid from right to left (with reference to FIG. 2) into the support member 56 until the cassette 14 reaches the position in the support member 56 shown in FIG. 2, the cassette 14 being held in operation in this position by manually releasable latch means (not shown).

The above-mentioned modification of the cassette 14 involves the provision of a second flexible shutter 68. When the cassette 14 is not mounted in the ATM, the shutter 68 serves to close an opening 70 (see FIG. 6) formed in a lockable lid 72 of the cassette 14, the opening 70 extending into the upper half of the front end 48 of the cassette 14. When the cassette 14 is mounted in the ATM by being slid into the support member 56, the shutter 68 is removed from the opening 70 to a position beneath the lid 72. The shutter 68 is provided with a rigid rearward extention 74 (FIG. 2) having a projection 76 which extends into a slot (not shown) formed in the lid 72, and the opening movement of the shutter 68 is brought by means of a projection 78 provided on the support member 56 engaging with the projection 76 when the cassette 14 is slid into the support member 56. It should be understood that when the cassette 14 is removed from the ATM by being slid out of the support member 56, the shutter 68 is automatically returned to its closed position by spring means (not shown), with the extension 74 serving to close the slot in the lid 72.

As seen in FIGS. 3 and 4, the support member 56 is slidably mounted between side walls 80 of a supporting framework 82 of the ATM by bearing means 84, the support member 56 being movable in a horizontal direction forwardly (i.e. from right to left with reference to FIG. 2) or rearwardly relative to the framework 82. A rack member 86 is secured to the underside of the support member 56, the rack member engaging with a pinion 88 secured on a drive shaft 90 rotatably mounted on the framework 82. The shaft 90 is driven by a stepping motor 92 (FIG. 12) controlled by the electronic control means 19. Thus, for a purpose which will be explained later, movement of the support member 56, together with the cassette 14 mounted thereon, can be brought about by the motor 92 via the pinion 88 and the rack member 86.

Deposited notes are fed to the picker/loader mechanisms 10 and 12 along the input feed path 24 (FIG. 1) by a transport mechanism 94 including feed belts 96, 98 and 100 which pass around pulleys 102 as shown in FIG. 2.

The transport mechanism 94 is driven by a main drive motor 96 (FIG. 12).

Referring to FIG. 2, the picker/loader mechanism 10 includes drive pulley means 104 secured on a drive shaft 106 driven by the main drive motor 96. A first plurality of feed belts 108 pass around, and are driven by, the pulley means 104, the belts 108 being spaced apart along the axis of the shaft 106 and also passing around associated pulley means 110. A second plurality of feed belts 112 also pass around, and are driven by, the pulley means 104, the belts 112 being interspersed with respect to the belts 108 and passing around associated pulley means 114. The belts 108 and 112 are continuously driven during operation of the picker/loader mechanism 10.

Figure 6:
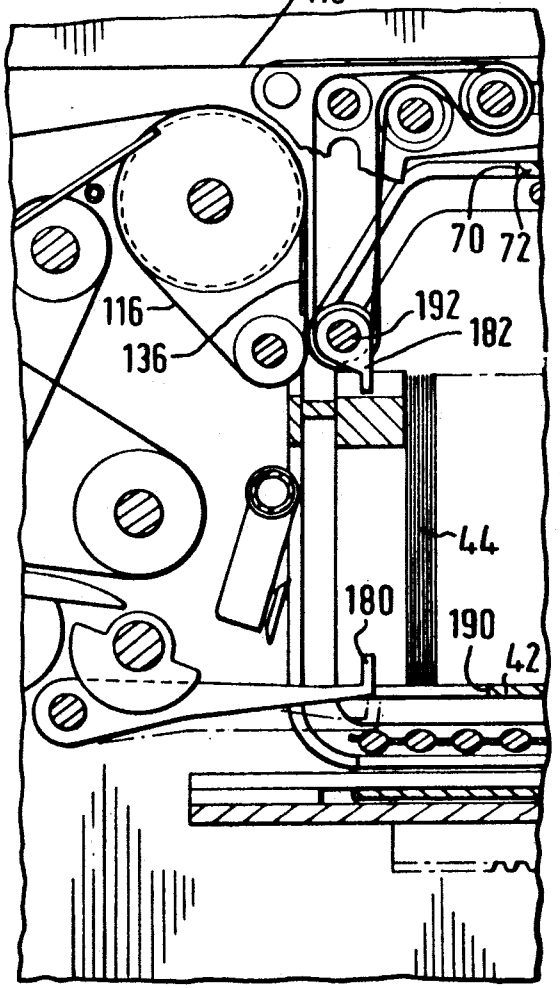
FIG. 6 is a sectional, side elevational view of part of the picker/loader mechanism and the front part of the cassette, showing the positions of said mechanism and of the cassette during change-over from a picking mode of operation to a loading mode of operation.
Figure 5:
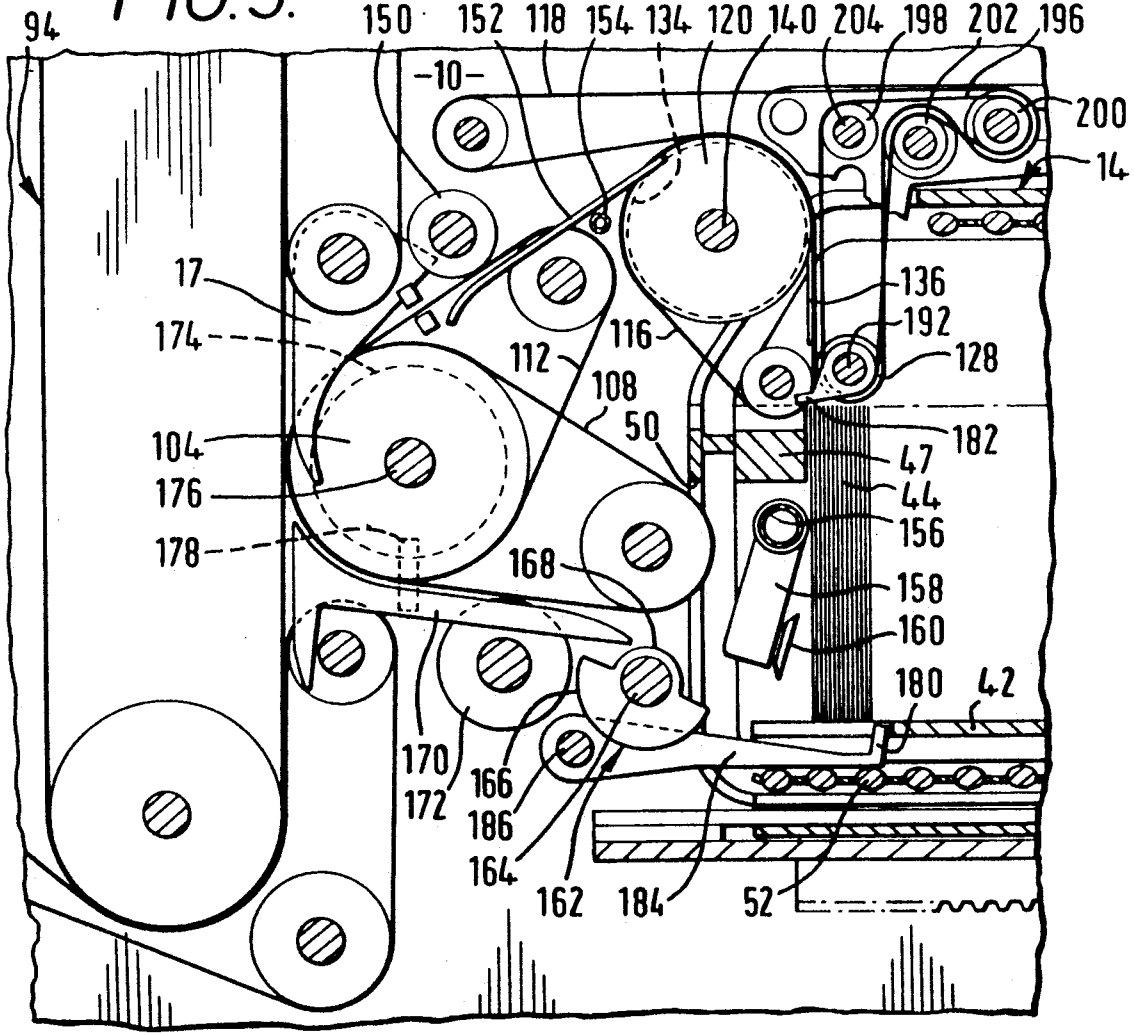
FIG. 5 is a sectional, side elevational view of the picker/loader mechanism and the front part of the cassette, said mechanism being in a picking mode of operation.

Referring now additionally to FIGS. 3 to 6, the loading portion of the picker/loader mechanism 10 includes two feed belts 116 which are mounted in cooperative relationship with respect to two further feed belts 118. The belts 116 pass around pairs of pulleys 120 and 122, while the belts 118 pass around further pairs of pulleys 124, 126 and 128 and over parts of the peripheries of the pulleys 120 and a further pair of pulleys 130. The pulleys 120, 124, 126 and 128 are rotatably mounted with respect to the side walls 80 of the framework 82, while the pulleys 122 and 128 are rotatably mounted With respect to side walls 131 of a further supporting framework 132 which is positioned between, and secured to, the side walls 80. It should be understood that, when the cassette 14 is mounted in an operational picking or loading position relative to the picker/loader mechanism 10, the framework 132 projects into the interior of the cassette 14 through the opening 70 with the pulleys 122 and 128 disposed inside the cassette 14. The pulleys 120 and 124 are intermittently driven by a stepping motor 133 (FIG. 12) via appropriate gear means (not shown) such that, when operating, the cooperating belts 116 and 118 are driven at the same speed. Referring particularly to FIG. 2 and 3, the loading portion of the picker/loader mechanism 10 also includes two cylindrical holders 134, each of which serves as a housing for a respective flexible metal tape 136. Each tape 136 is housed in coiled manner in the respective holder 134 with a free end of the tape 136 projecting vertically downwards from the holder 134 through a slot 138 (FIG. 3) formed in the periphery of the holder 134. The holders 134 are mounted on a shaft 140 to which are secured the pulleys 120, the holders 134 being mounted so that they are held in a fixed position while permitting rotation of the shaft 140 relative to the holders 134. Each tape 136 is arranged to be driven by a drive mechanism incorporating a gear wheel 142 rotatably mounted on the shaft 140. Each gear wheel 142 is driven by a gear wheel 144 (FIG. 2) which in turn is driven by a stepping motor 146 (FIG. 12). By means of the motor 146, the tapes 136 may be driven between a first position in which the free ends of the tape 136 are in an extended lowermost position as shown in FIGS. 2 and 3, and a second position in which the free ends of the tapes 136 are in a retracted uppermost position as shown in FIGS. 5 and 6. The tapes 136 are set to be in said first position when the picker/loader mechanism 10 is in a loading mode of operation, and are set to be in said second position when the mechanism 10 is in a picking mode of operation.

A currency note fed by the feed mechanism 94 to the picker/loader mechanism 10 for loading into the cassette 14 is first gripped between the belt means 96 and the belts 108 and 112 passing around the pulley means 104, and is then diverted into the mechanism 10 by the associated gate 17 which is set to its loading position as shown in FIG. 2. After being diverted by the gate 17, the leading edge of the note is sensed by optical sensing means 148 and shortly thereafter the note is gripped between the belts 112 and cooperating roller means 150. The note is fed by the belts 112 and roller means 150 over guide means 152 to the entry nip of the belts 116 and 118. A tube 154 connected to an air pump (not shown) is positioned beneath the guide means 152. In operation, upwardly directed air jets are emitted by the tube 154 via orifices in the tube 154 and through openings in the guide means 152 for a purpose which will be explained later. As will be described in more detail later, during a loading operation, currency notes fed to the picker/loader mechanism 10 by the feed mechanism 94 are fed in overlapping manner by the belts 116 and 118 into the interior of the cassette 14, with the extended metal tapes 136 serving to guide and partially support notes fed into the cassette 14.

The picking portion of the picker/loader mechanism 10 includes a tubular member 156 which extends between, and is rotatably mounted with respect to, the side walls 80. Two conventional pick arms 158, each incorporating a rubber suction pad 160, are secured on the tubular member 156, each pick arm 158 communicating with the interior of the tubular member 156. One end of the tubular member 156 projects beyond the corresponding side wall 80 and is connected by connection means (not shown) to a source of reduced pressure. During a picking operation, the pick arms 158 are caused to undergo an oscillatory pivotal movement in conventional manner. It should be understood that when the cassette 14 is mounted on the support member 56, the pick arms 158 pass into the interior of the cassette 14 through the opening 50, with the tubular member 156 extending through recesses 161 (FIG. 4) in the front edges of the side walls 60 of the cassette 14 and passing in front of the side walls 66 of the support member 56.

Referring now particularly to FIG. 5, cam roll means 162 are secured on a drive shaft 164 in cooperative relationship with respect to the belt means 108, the periphery of the cam roll means 162 comprising a high portion 166 and a low portion 168. In the course of a pick operation, the first currency note of the stack of notes 44 in the cassette 14 is engaged by the suction pads 160 of the pick arms 158. The lower long edge of this note is then pulled partly out of the cassette 14 through the opening 50, under the action of suction applied by the pick arms 158, and is fed between the low portion 168 of the cam roll means 162 and the belts 108 as the arms 158 are pivoted in a clockwise direction with reference to FIG. 5. This note is thereafter pulled completely out of the cassette 14 by virtue of being gripped between the belts 108 and the high portion 166 of the Cam roll means 162 with the note being fed between guide means 170 and the belts 108. The note is then gripped and fed by the belts 108 and cooperating roller means 172, and is fed out of the picker/loader mechanism 10 by the feed mechanism 94 in cooperation with the belts 108 and 112, the gate 17 having previously been set to the picking position shown in FIG. 5. As previously mentioned, after leaving the picker/loader mechanism 10, the picked note is fed to the stacker means 36 (FIG. 1).

A timing disc 174 is mounted on the shaft 106 on which are secured the pulley means 104, the shaft 176 being driven by the main drive motor 96. The timing disc 174 is operatively associated with a sensor 178. In operation of the picker/loader mechanism 10, the sensor 178 applies a series of timing pulses to the electronic control means 19.

The picker/loader mechanism 10 includes a lower pair of note retaining pawls 180 and an upper pair of note retaining pawls 182, the pawls 180 and 182 being located inside the cassette 14 when the cassette 14 is mounted in its operational picking or loading position relative to the mechanism 10. The lower pawls 180 are respectively provided at corresponding ends of a pair of arms 184, the other ends of which are secured on a shaft 186 which is rotatably mounted with respect to the side walls 80 and which is driven by a stepping motor 188 (FIG. 12). The arms 184 extend into the cassette 14 through the opening 50 and above the shutter 52, with the pawls 180 extending into or passing through slots 190 (see FIG. 6) formed in the floor member 42 of the cassette 14. Under the control of the motor 188, the pawls 180 are movable between the non-operative position shown in FIG. 5 in which the pawls 180 are positioned below the upper surface of the floor member 42, and the operative position shown in FIG. 6 in which the pawls 180 are positioned above the upper surface of the floor member 42.

Referring particularly to FIGS. 4 and 5, the upper pawls 182 are secured on a shaft 192 which extends between, and is rotatably mounted with respect to, the side walls 131 of the framework 132. A toothed pulley 194 (FIG. 4) is secured on the shaft 192, while the pulleys 128 associated with the belts 118 are rotatably mounted on the shaft 192. An endless toothed belt 196 passes around the pulley 194 and also around toothed pulleys 198 and 200 and partly over the periphery of a pulley 202. The pulley 198 is secured on a drive shaft 204 which extends between, and is rotatably mounted with respect to, the side walls 80, the drive shaft 204 being driven by a stepping motor 206 (FIG. 12). Under the control of the motor 206, the pawls 182 are pivotable between the operative position shown in FIGS. 2 and 6 in which the pawls 182 extend below the upper front edge of the stack of notes 44, and the non-operative position shown in FIG. 5 in which the pawls 182 are positioned above the stack of notes 44.

Operation of the picker/loader mechanism 10 will now be described. Initially, in response to a signal from the manually operated keyboard control means 20 (FIG. 12), the electronic control means 19 energizes the main drive motor 96 so as to cause the transport mechanism 94, the feed belts 108 and 112 and associated roller means 150 and 172, and the cam roll means 162 to commence operation. At the same time, the sensor 178 associated with the timing disc 174 commences to apply timing pulses to the electronic control means 19.

Referring particularly to FIG. 5, there will first be described the operation of the picker/loader mechanism 10 during a picking mode of operation forming part of a cash withdrawal operation, it being assumed that a plurality of notes will be picked from the stack of notes 44 in the cassette 14 and fed by the transport mechanism 94 to the stacker means 36. Prior to the picking operation commencing, under the control of the electronic control means 19, the gate 17 is set to the picking position shown in FIG. 5, the pawls 180 are set by the motor 188 to their non-operative position beneath the upper surface of the floor member 42, the pawls 182 are set by the motor 206 to the non-operative position shown in FIG. 5 in which they are above the stack of notes 44, and the steel tapes 136 are set by the motor 146 to their retracted position above the stack of notes 44. The stack of notes 44 is urged by the pusher plate 46 (FIG. 2) against the stop member 47, with the front note in the stack 44 being positioned adjacent the suction pads 160 of the pick arms 158. The pick arms 158 are then caused by the electronic control means 19 to commence their oscillatory pivotal movement so as to cause the notes to be picked one by one from the cassette 14 and fed to the stacker means 36 in the manner previously described. When the required number of notes have been picked from the cassette 14, the operation of the pick arms 158 is stopped. It should be understood that, during the cash withdrawal operation, notes may also be picked from the cassette 16 by the associated picker/loader mechanism 12 for feeding to the stacker means 36, operation of the picker/loader mechanism 12 taking place before or after the operation of the picker/loader mechanism 10.

If a loading operation of the picker/loader mechanism 10, forming part of a cash deposit operation of the ATM, is to take place subsequent to a picking operation, then the following events take place prior to the loading operation commencing. Firstly, under the control of the electronic control means 19, the assembly of the support member 56 and the cassette 14 is moved by the motor 92 via the pinion 88 and the rack member 86 from left to right with reference to FIG. 2 from the leftmost position shown in FIG. 2 to the rightmost position shown in FIG. 6. The pawls 180 and 182 are then moved to the operative positions shown in FIG. 6 in which they are positioned in front of the stack of notes 44. The assembly of the support member 56 and the cassette 14 is then moved by the motor 92 back to the position shown in FIG. 2. During this return movement of the assembly of the support member 56 and the cassette 14 to its leftmost position, the front note in the stack of notes 44 is engaged and stopped by the pawls 180 and 182 as shown in FIG. 2, with the pawls 180 engaging the lower front edge of the stack 44 and the pawls 182 engaging the upper front edge of the stack 44. The steel tapes 136 are then moved by the motor 146 to their extended position in which the free ends of the tapes 136 are positioned a short distance above the floor member 42. It will be appreciated that, by virtue of this rearward and return movement of the assembly of the support member 56 and the cassette 14 combined with the movement of the pawls 180 and 182, there is created a space 208 (FIG. 2) between the steel tapes 136 and the pawls 180 and 182 into which a plurality of notes may be loaded. In addition to the preliminary operations just described, the gate 17 is set to the loading position shown in FIG. 2 prior to the commencement of the loading operation.

The loading of a plurality of notes into the cassette 14 by the picker-loader mechanism 10 involves feeding the notes one by one to the entry nip of the belts 116 and 118 in the manner previously described, with the long edges of the notes being perpendicular to the feed path. Referring particularly to FIG. 2 and FIGS. 7 to 11, in response to the sensing of the leading edge of the first note 44 fed into the picker/loader mechanism 10, the sensing means 148 sends a signal to the electronic control means 19. A predetermined time after the receipt of this last mentioned signal, as represented by the counting of a predetermined number of timing pulses from the sensor 178 by the electronic control means 19, the electronic control means 19 starts the stepping motor 133 so as to cause the feed belts 116 and 118 to commence operation, such operation commencing prior to the leading edge of the first note $44^1$ reaching the nip of the feed belts 116 and 118.

Figure 7:
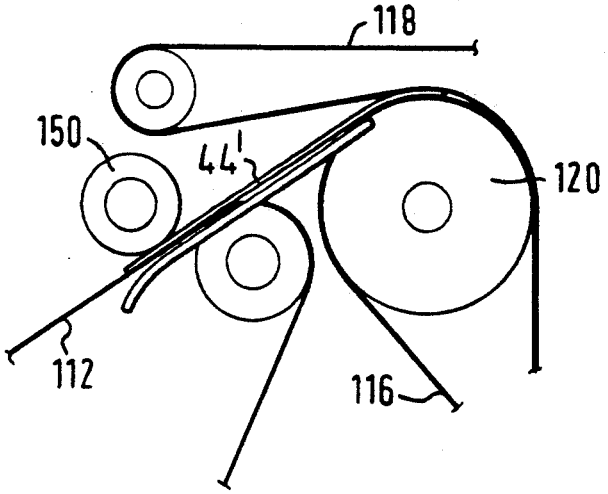
FIG. 7 to 11 are schematic views showing different stages in the operation of feeding means for feeding currency notes in overlapping manner to the front end of the currency cassette during a loading mode of operation.
Figure 8:
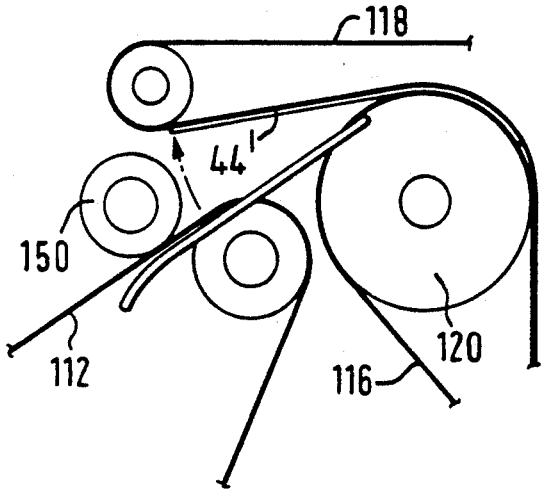

The spacing between the pulleys 120 and the roller means 150 is such that, when the leading edge of the first note $44^1$ reaches the nip of the feed belts 116 and 118 and becomes gripped thereby, the trailing edge of the note $44^1$ is still gripped between the belts 112 and the roller means 150, as shown in FIG. 7. It should be understood that, upon a leading portion of the note $44^1$ being gripped and driven by the belts 116 and 118, this portion is bent over part of the periphery of each of the pulleys 120, so that this portion is deflected away from the feed path defined by the cooperating feed belts 112 and roller means 150. Shortly after the leading portion of the note $44^1$ is gripped and driven by the feed belts 116 and 118, the trailing edge of the note $44^1$ moves out of contact with the roller means 150, whereupon, as shown in FIG. 8, a trailing portion of the note $44^1$ springs away from the last-mentioned feed path, by virtue of the inherent resilience or stiffness of the note $44^1$, and into contact with the belts 118. The movement of the trailing portion of the note $44^1$ into contact with the belts 118 is assisted by the upwardly directed jets of air from the tube 154 (FIG. 2) referred to previously. A further short time after the trailing portion of the note $44^1$ has sprung into contact with the belts 118, the motor 133 is stopped by the electronic control means 19 so as to stop the operation of the drive belts 116 and 118. At this time, the note $44^1$ is stopped with a trailing portion in contact with the belts 118 and positioned above the belts 112, in a position similar to that shown in FIG. 8.

Figure 9:
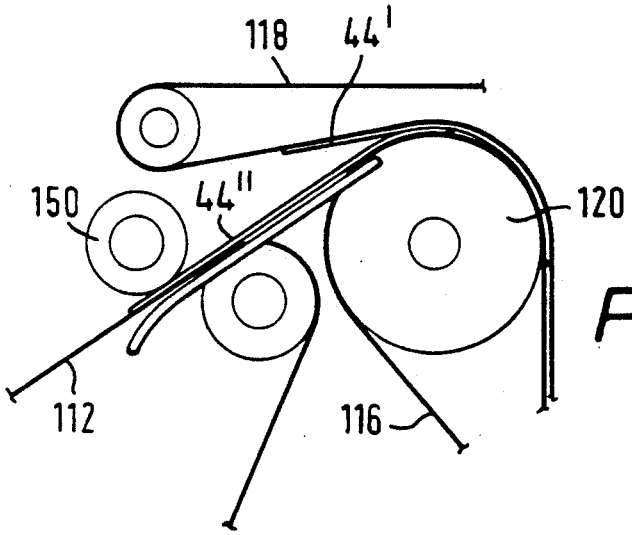
Figure 10:
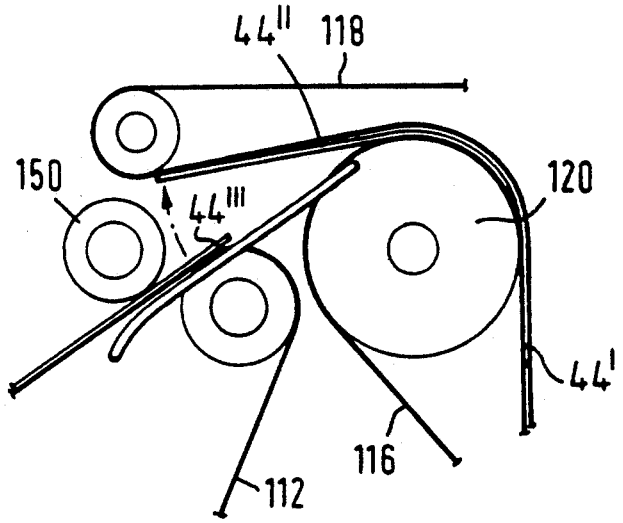

It should be understood that the belts 112 and roller means 150, driven by the motor 96, operate continuously during operation of the picker/loader mechanism 10. Thus, while the first note $44^1$ is stopped as just mentioned, the next note $44^{11}$ is fed by the belts 112 and roller means 150 towards the nip of the belts 116 and 118. As in the case of the first note $44^1$, the leading edge of the second note $44^{11}$ is sensed by the sensing means 148, in response to which a signal is sent by the sensing means 148 to the electronic control means 19. A predetermined time after receipt of this last-mentioned signal, the electronic control means 19 again starts the stepping motor 133 so as to cause the belts 116 and 118 to recommence operation, this recommencement of operation occurring prior to the leading edge of the second note $44^1$ reaching the nip of the belts 116 and 118. Prior to operation of the belts 116 and 118 recommencing, the leading edge of the second note $44^{11}$ moves beneath the trailing portion of the first note $44^1$ so that a leading portion of the note $44^{11}$ is positioned in overlapping relationship with respect to the note $44^1$. When the operation of the belts 116 and 118 recommences, the two notes $44^1$ and $44^{11}$ are fed together, in overlapping relationship, partly around the peripheries of the pulleys 120, as shown in FIG. 9.

Figure 11:
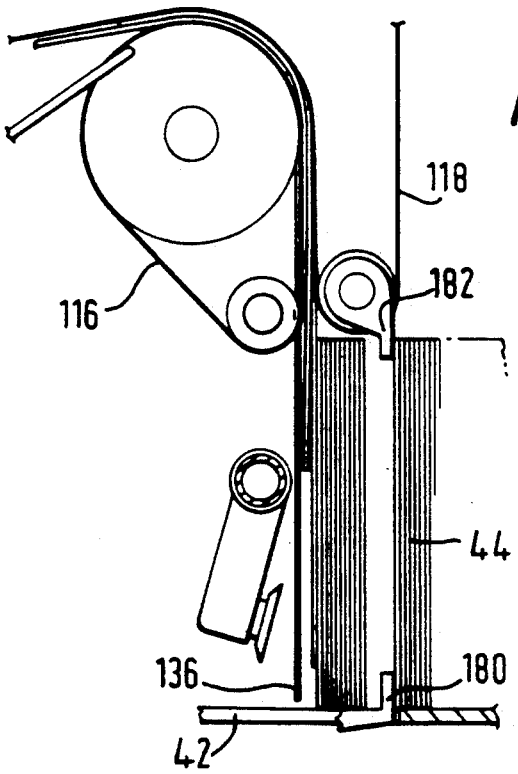

In a similar manner to that described with reference to the first note $44^1$, when the trailing edge of the second note $44^{11}$ moves out of contact with the roller means 150, a trailing portion of the note $44^{11}$ springs away from the feed path defined by the belts 112 and roller means 150 and into contact with the belts 118. Shortly thereafter, the belts 116 and 118 are again stopped with the overlapping notes $44^1$ and $44^{11}$ in the overlapping position shown in FIG. 10. The next note $44^{111}$ (FIG. 10) is then fed by the belts 112 and roller means 150 to a position in which a leading portion of the note $44^{111}$ is in overlapping relationship with respect to the note $44^{11}$, and operation of the belts 116 and 118 is then restarted once again. Thus, it will be appreciated that a stream of overlapping notes is fed by the belts 116 and 118 along a feed path defined by the belts 116 and 118 and by the steel tapes 136 until the leading edges of the notes abut against the floor member 42 of the currency cassette 14. In this manner, currency notes are fed into the cassette 14 and formed into a stack between the steel tapes 136 and the pawls 180 and 182 as shown in FIG. 11, with corresponding long edges of the notes in this stack being supported by the floor member 42 and with one side of this stack being supported by the steel tapes 136. It will be appreciated that because the notes are fed into the cassette 14 in an overlapping manner, there is no risk of the leading edge of each successive note hitting, or becoming jammed against, an edge of a preceding note.

A stack of up to 20 notes can be loaded into the cassette 14 into the space 208 between the steel tapes 136 and the pawls 180 and 182. If it is desired to load more than 20 notes into the cassette 14, then after 20 notes have been fed to the picker/loader mechanism 10, the transport mechanism 94 is stopped, the pawls 180 and 182 are moved to their non-operative positions, and the steel tapes 136 are moved to their retracted position. This enables the stack of notes 44 present in the cassette 14 prior to the commencement of the loading operation to be combined with the newly loaded notes, the pusher plate 46 pushing the combined stacks against the stop member 47. A further space 208 for accommodating a further stack of loaded notes is then created by moving the assembly of the support member 56 and the cassette 14 to its rightmost position, moving the pawls 180 and 182 to their operative positions, and returning said assembly to its leftmost position, the steel tapes 136 then being returned to their extended position. This procedure may be repeated as many times as may be necessary, or until the cassette 14 is full.

To return the picker/loader mechanism 10 to a picking mode of operation from a loading mode of operation, the gate 17 is set to its picking position, the steel tapes 136 are set to their retracted position, and the pawls 180 and 182 are set to their non-operative positions, thereby enabling the pusher plate 46 to push the stack of notes 44 into engagement with the stop member 47.

The cassette 14 is provided with sensing means (not shown) for providing a signal to the electronic control means 19 if the number of notes in the cassette 14 reaches a predetermined low level or a predetermined high level. Upon receipt of such signal, the electronic control means 19 causes the generation of a warning signal indicative that removal of the cassette 14 from the picker/loader mechanism 10 is required. The cassette 14 is removed by sliding it rearwardly out of the support structure 56 and it is then replaced by a partially filled cassette, enabling the picker/loader mechanism 10 to recommence operation in either a picking or a loading mode.

It should be understood that the construction and operation of the picker/loader mechanism 12 and the cassette 16 are the same as the construction and operation of the picker/loader mechanism 10 and the cassette 14.

The picker/loader mechanism 10 described above has the advantages that it is of simple construction and is simple to operate, and also is reliable in operation.

While the form of the invention shown and described herein is admirably adapted to fulfill the objects primarily stated, it is to be understood that it is not intended to confine the invention to the form or embodiment disclosed herein, for it is susceptible of embodiment in various forms within the scope of the appended claims.

What is claimed is:

1. A sheet handling apparatus operable in a loading mode and in a picking mode, comprising:

a receptacle arranged to hold a stack of sheets and including a pusher member to urge said sheets, when said apparatus is in a picking mode, against a stop member in said receptacle;

loading means for loading sheets into said receptacle when said apparatus is in said loading mode;

picking means for picking sheets one by one from said receptacle when said apparatus is in said picking mode;

a movable support member on which said receptacle is mounted in operation;

first actuating means arranged to move said support member together with said receptacle between an operative position in which loading or picking takes place and a non-operative position;

movable stack retaining means operable to retain the stack of sheets within the receptacle;

second actuating means arranged to move said retaining means between operative and non-operative positions; and control means arranged to control the operation of said first and second actuating means, whereby when said support member is in operative position, said stack retaining means are in their non-operative position during a picking mode and are in their operative position during a loading mode, and whereby, when said apparatus changes from a picking mode to a loading mode, said support member is moved to its non-operative position and said retaining means are moved to their operative positions after which said support member is moved to its operative position, said pusher member urging said stack against said retaining means with a space having been created between said stack and said stop member for accommodating a plurality of sheets additional to said stack.

2. The apparatus of claim 1, in which said receptacle is removably mountable on said support member and includes an enclosure having first and second openings and first and second shutters for closing said first and second openings, said apparatus being provided with means for bringing about automatic opening of said shutters when said receptacle is mounted on said support member, portions of said picking means and said loading means passing into the interior of said receptacle through said first and second openings respectively when said receptacle is mounted on said support member.

3. The apparatus of claim 2, in which said stack retaining means comprise lower retaining means movable between operative and non-operative positions and arranged to engage a lower end edge of said stack when in their operative position, and upper retaining means movable between operative and non-operative positions and arranged to engage an upper end edge of said stack when in their operative position.

4. The apparatus of claim 3, in which said lower and upper retaining means are respectively formed by pivotably movable upper and lower pawls.

5. The apparatus of claim 3, in which said lower retaining means and said upper retaining means are positioned so as to pass into the interior of said receptacle through said first and second openings respectively when said receptacle is mounted on said support member.

6. The apparatus of claim 1, also including sheet support means movable under the control of said control means between first and second positions, said sheet support means being arranged to be in said first position in which said sheet support means extend into said space when said apparatus is in said loading mode, and being arranged to be in said second position in which said sheet support means are retracted out of said space when said apparatus is in said picking mode.

7. The apparatus of claim 6, in which said sheet support means comprise flexible metal tapes.

8. The apparatus of claim 7, also including holder means for housing said tapes in coiled manner, and actuating means for causing a free end portion of said tapes to be moved into and out of said space.

9. The apparatus of claim 1, in which said loading means includes first feed means arranged to feed in continuous manner during a loading operation a plurality of sheets one by one in spaced relationship to one another along a first feed path, and second feed means, to which said sheets are fed by said first feed means, said second feed means arranged to feed said plurality of sheets along a second feed path, the leading portion of a sheet when first engaged and driven by said second feed means being deflected away from said first feed path whereby a trailing portion of each sheet when leaving said first feed means is deflected away from said first feed path, said control means being arranged to control the operation of said second feed means whereby, following the engagement of a sheet by said second feed means and following the deflection of a trailing portion of this sheet away from said first feed path, operation of said second feed means is stopped until the leading edge of the next sheet is positioned in overlapping relationship with respect to the immediately preceding sheet after which operation of said second feed means is recommenced, said second feed means serving under the control of said control means to feed said plurality of sheets in overlapping manner along said second feed path into said space.

10. The apparatus of claim 9, also including sensor means positioned upstream of said second feed means and arranged to send a signal to said control means in response to said sensor means sensing an edge of a sheet being fed by said first feed means, said control means being arranged to cause operation of said second feed means to commence a predetermined time after the receipt of said signal by said control means.

* * * * *